US011819066B2

(12) United States Patent
Severson

(10) Patent No.: US 11,819,066 B2
(45) Date of Patent: Nov. 21, 2023

(54) BABY WRAP AND METHOD OF USE

(71) Applicant: Leah Therese Severson, Westfield, IN (US)

(72) Inventor: Leah Therese Severson, Westfield, IN (US)

( * ) Notice: Subject to any disclaimer, the term of this patent is extended or adjusted under 35 U.S.C. 154(b) by 0 days.

(21) Appl. No.: 16/825,405

(22) Filed: Mar. 20, 2020

(65) Prior Publication Data

US 2020/0323288 A1 Oct. 15, 2020

Related U.S. Application Data

(60) Provisional application No. 62/821,760, filed on May 28, 2019, provisional application No. 62/832,534, filed on Apr. 11, 2019.

(51) Int. Cl.
*A41B 13/06* (2006.01)
*A41D 1/21* (2018.01)

(52) U.S. Cl.
CPC ..... *A41D 1/21* (2018.01); *A41B 13/06* (2013.01)

(58) Field of Classification Search
CPC ..... A41D 1/21; A41D 2400/482; A41D 13/1272; A41B 13/06; A41B 13/065; A41B 13/08; A47G 9/068
See application file for complete search history.

(56) References Cited

U.S. PATENT DOCUMENTS 4,759,082 A * 7/1988 Mulligan ..... A41D 15/04 2/69.5
2005/0217004 A1* 10/2005 Haberfeld ..... A41B 13/06 2/69.5
2005/0218168 A1* 10/2005 Chua ..... A41B 13/06 224/160
2014/0317828 A1* 10/2014 Holsinger ..... A41B 13/08 2/80
2019/0274366 A1* 9/2019 Hilton ..... A41D 10/00

FOREIGN PATENT DOCUMENTS

DE 102008059469 A1 * 6/2009 ..... A41B 13/06

OTHER PUBLICATIONS

HomeSewn Photography Props, Apr. 2, 2019, https://m.facebook.com/homesewnphotographyprops/videos/i-have-7-underwraps-in-stock-and-rts-if-you-hate-to-wrap-or-your-wrapped-babies-/319473058754303/?refsrc=deprecated&_rdr (last visited Feb. 2, 2022) (Year: 2019).*

* cited by examiner

*Primary Examiner* — Patrick J. Lynch
(74) *Attorney, Agent, or Firm* — Frost Brown Todd LLP

(57) ABSTRACT

A wrap for an infant is provided. The wrap includes a first part configured as a loop having a through opening. A second part attached with the first part to seal off a portion of the opening and form a pouch configured to receive a bottom half of an infant. A portion of the first part including an elastic band configured for disposal adjacent a top of a diaper. Systems and methods are disclosed.

2 Claims, 7 Drawing Sheets

BABY WRAP AND METHOD OF USE

TECHNICAL FIELD

The present invention relates to a wrap used to swaddle an infant.

BACKGROUND

Swaddling, which is wrapping or binding around an infant, has traditionally been practiced using a blanket or strips of cloth which are tightly wrapped around the infant. Swaddling an infant has been shown to increase sleep duration with fewer awakenings. The wrap helps calm the infant and prevents the infant from being awakened. The wrap may be made of cotton fabric stretchy material and may be attached to the infant without the use of added fasteners.

SUMMARY OF INVENTION

In one embodiment, a wrap for an infant is provided. The wrap includes a first part configured as a loop having a through opening. A second part attached with the first part to seal off a portion of the opening and form a pouch configured to receive a bottom half of an infant. A portion of the first part including an elastic band configured for disposal adjacent a top of a diaper. Systems and methods are disclosed.

In some embodiments, a method for wrapping a bay is provided. The method includes the steps of: providing a wrap having a first part configured as a loop having a through opening and a top portion with a seam; a second part attached with the first part to seal off a portion of the opening and form a pouch; and a portion of the first part including an elastic band; positioning the wrap with the elastic band towards the infant; positioning the seam adjacent a head of the infant; placing the top portion over the head of the infant such that the head is placed through the opening; positioning the top portion behind a neck of the infant; pulling the wrap down over legs of the infant; and pulling the elastic band around feet of the infant and adjacent to a top waist band of a diaper such that a bottom half of the infant is positioned in the pouch.

In some embodiments, the method of wrapping an infant, includes the steps of: providing a wrap having a first part configured as a loop having a through opening and a top portion with a seam; a second part attached with the first part to seal off a portion of the opening and form a pouch and a second opening within the pouch; and a portion of the first part including an elastic band; positioning the wrap with the elastic band towards the infant; positioning the seam adjacent a head of the infant; placing the top portion over the head of the infant such that the head is placed through the opening; positioning the top portion behind a neck of the infant; pulling the wrap down over legs of the infant; pulling the elastic band around feet of the infant and adjacent to a top waist band of a diaper; and pulling the legs of the infant through the second opening.

BRIEF DESCRIPTION OF THE DRAWINGS

The present disclosure will become more readily apparent from the specific description accompanied by the following drawings, in which.

DETAILED DESCRIPTION

Figure 1:
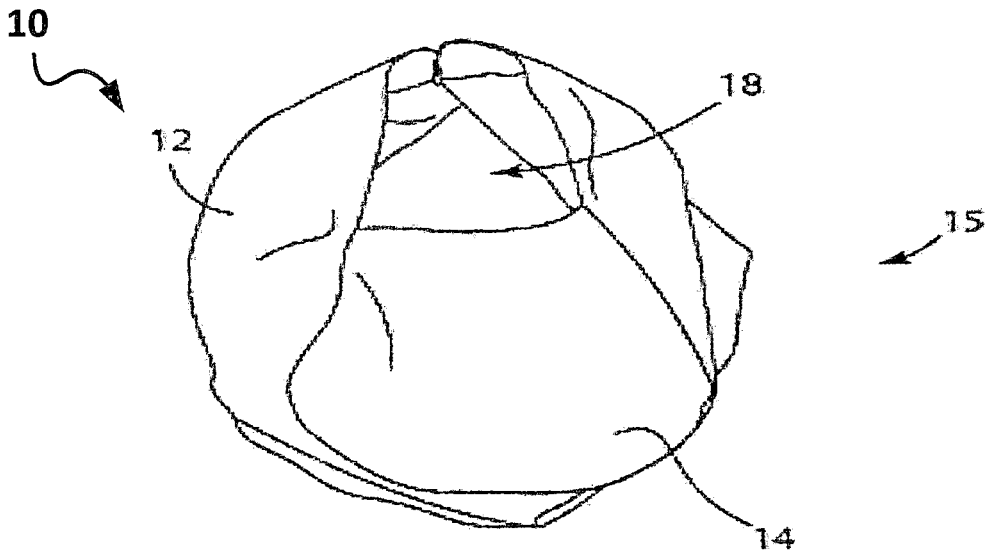
FIG. 1 is a perspective view of the components of one embodiment of the wrap in accordance with the principles of the present disclosure.

The described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In one embodiment, a wrap system is configured as an under wrapping layer. The wrap slides over the head, then around the torso, holding the baby in a round position. In some embodiments, the wrap system encloses the feet. In some embodiments, the wrap system allows the feet to be exposed. In some embodiments, the wrap system includes an overlay tucking layer and a loop part. In some embodiments, the wrap system includes an elongated part configured to wrap multiple times around the infant. In some embodiments, the elongated part is 16 inches by 60 inches. In some embodiments a second part, for example, a loop part is configured for disposal over the elongated part to hold the elongated part in place. In some embodiments, the wrap system includes a tubular portion configured for placement over the infant such that the torso and arms are positioned within the tubular part. A loop portion is placed over the infant's head and stretched under the legs to hold the legs in place.

The system of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of an infant wrap in accordance with the principles of the present disclosure. Alternate embodiments are also disclosed. Reference is made in detail to the exemplary embodiments of the present disclosure, which are illustrated in the accompanying figures. Turning to FIGS. 1-13, there are illustrated components of a wrap, for example, a wrap system 10. Wrap system 10 is configured to swaddle an infant I, as described herein.

Figure 2:
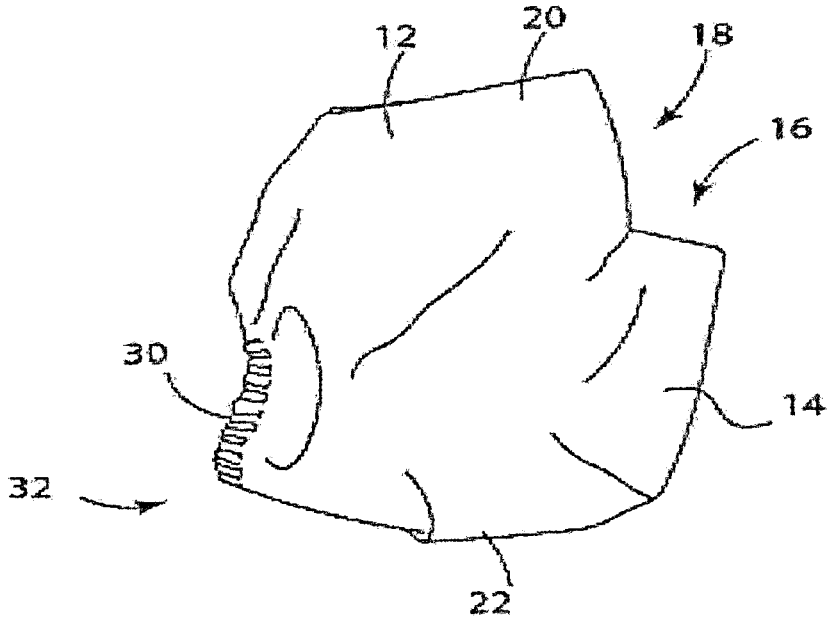
FIG. 2 is a side view of the components of FIG. 1.
Figure 3:
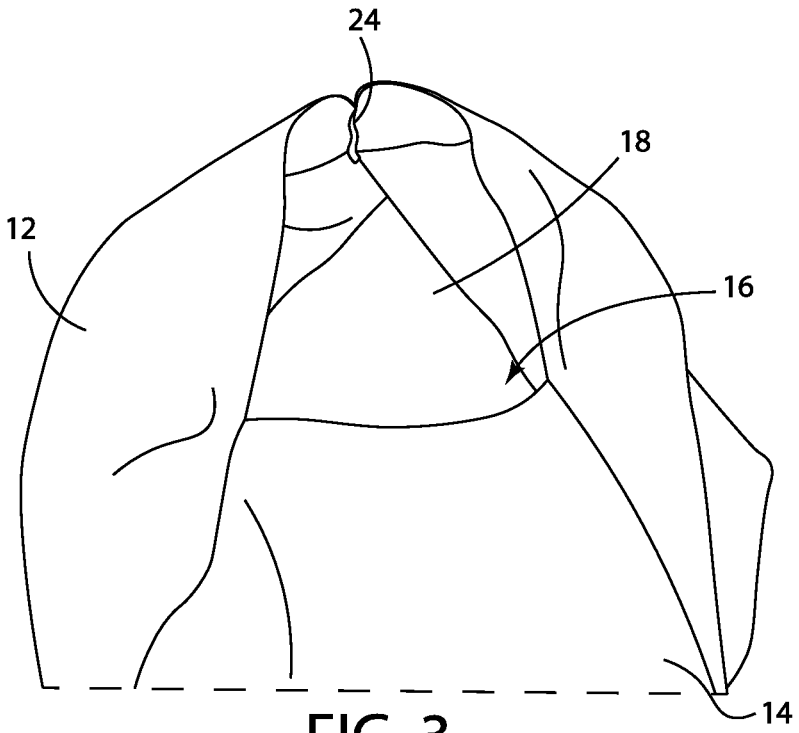
FIG. 3 is an enlarged view of the components of FIG. 1.
Figure 4:
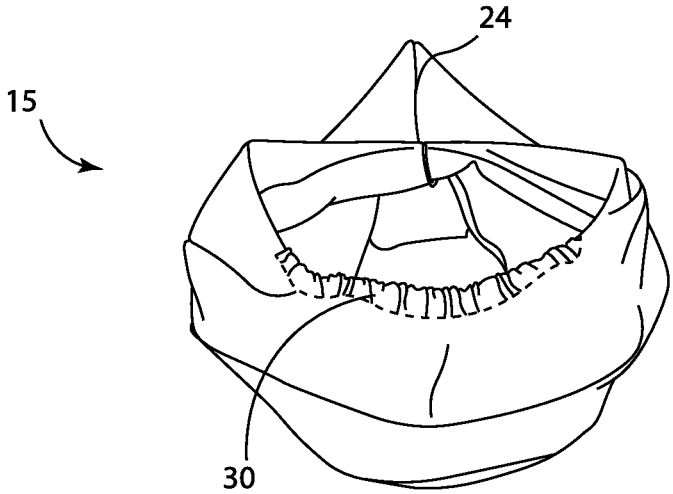
FIG. 4 is a bottom view of the components of FIG. 1.
Figure 5:
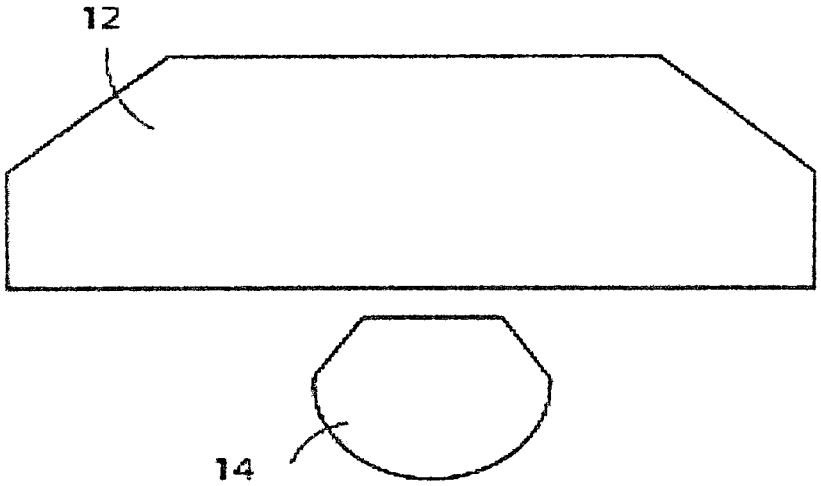
FIG. 5 is sewing pattern of the wrap in accordance with the principles of the present disclosure.

As shown in FIGS. 1-6, wrap system 10 includes a fabric part 12 and a fabric part 14, as shown in the sewing pattern in FIG. 5. Part 12 includes a loop shape, as shown in FIG. 2. Part 12 includes a top portion 20 and a bottom portion 22. Top portion 20 includes indicia, for example, a seam 24 configured to assist the user in aligning swaddle 15 properly with a head of infant I.

Part 14 is attached, for example, by sewing to part 12 to form a swaddle 15. In some embodiments, part 14 is attached with part 12 by other mechanisms, for example, gluing, Velcro®, snaps, buttons or other attachment means. Part 12 and/or part 14 are made from stretchable fabric having the ability to stretch, for example, stretch cotton cloth, Lycra, spandex, elastane, or knit fabrics which stretch due to the production method of looping.

Attachment of part 14 to part 12 forms a pouch 16 and an opening 18. Pouch 16 is configured to fit a body of infant I. Opening 18 is configured for placement of a head of infant I. In some embodiments, the circumference of part 12 forming opening 18 includes a pull string configured to adjust the fit around the neck of infant I. In some embodiments, part 12 includes a hood configured for placement on the head of infant I.

Part 12 includes an elastic band 30 along a back portion 32 of wrap system 10. In some embodiments, elastic band 30 can include braided elastic, knitted elastic, cotton elastic, latex free elastic, nylon elastic or polyester elastic. Elastic band 30 is configured for positioning adjacent the waistband of a diaper. Elastic band 30 facilities forming a snug fit around infant I. In some embodiments, other device can be utilized to tighten wrap system 10, for example, a pull string, a pull cord, buttons, snaps or Velcro®.

Figure 6:
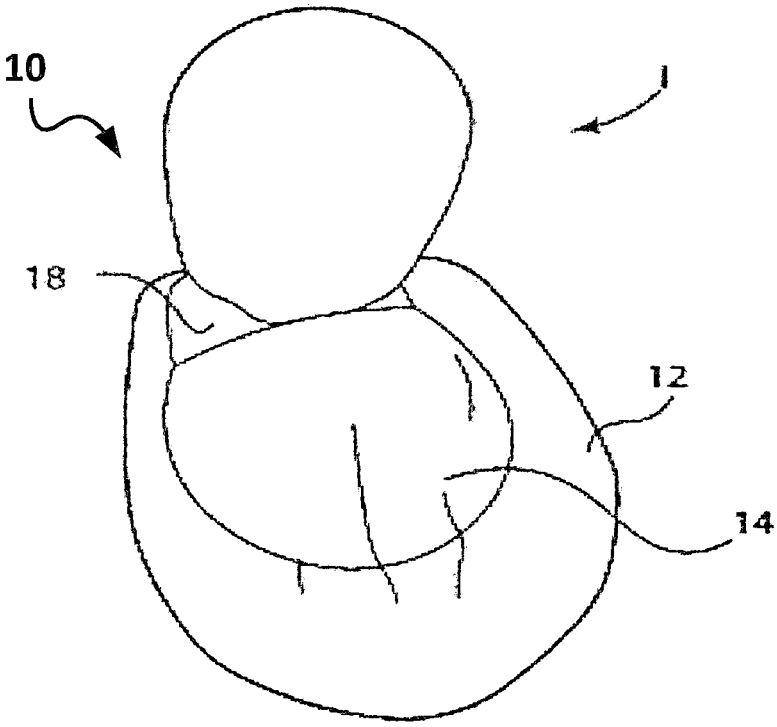
FIG. 6 is a perspective view of the components of one embodiment of the wrap in accordance with the principles of the present disclosure disposed with an infant.

In use, swaddle 15 is positioned such that elastic band 30 is towards infant I. The user positions seam 24 adjacent the head of infant I and is placed over the head of infant I and through opening 18. Top portion 20 is positioned behind a neck of infant I. Elastic band 32 is pulled down over legs of infant I, over the feet of infant I and elastic band 30 is pulled up along a backside of infant I for positioning adjacent the waist band of the diaper such that a bottom half of infant I is positioned in pouch 16, as shown in FIG. 6.

When infant I is positioned within wrap system 10, infant I is contained such that the legs are folded against the body and the arms are folded such that the hands are positioned towards the head. This position makes infant I feel like they are in the womb and more comfortable and less stressed, compared to current swaddle systems that compress the arms lengthwise against the body and restricts the legs is a straight position. In addition, use of wrap system 10 allows infant I to be placed within a car seat or baby swing without interfering with straps or belts designed to safely retain infant I.

Figure 7:
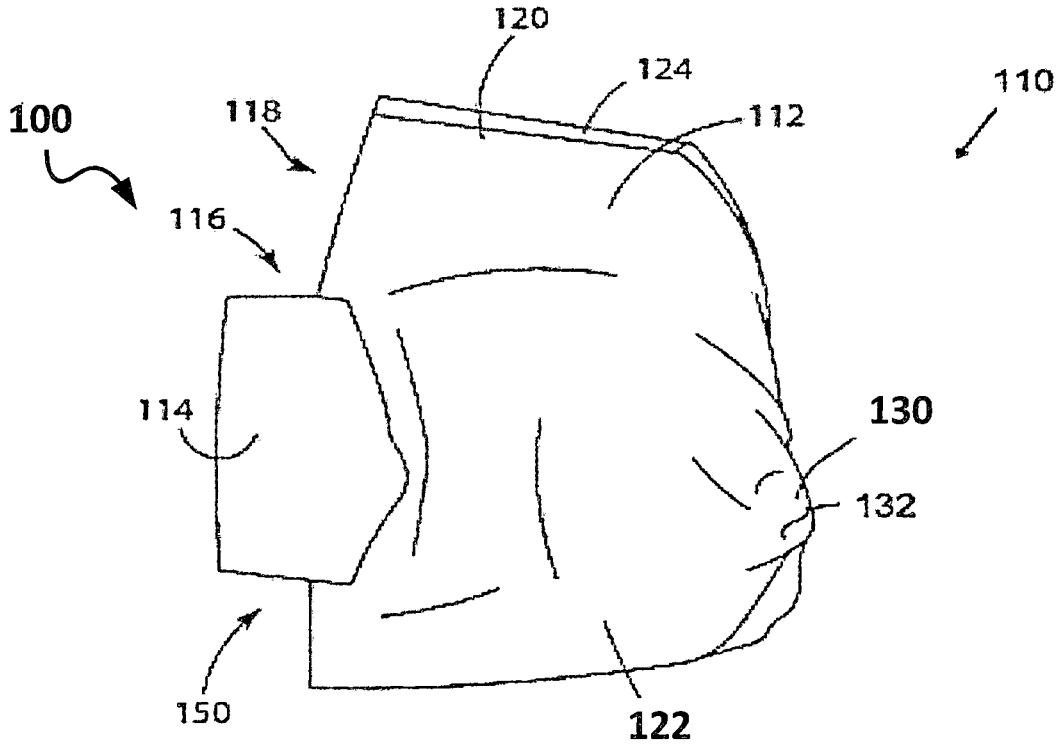
FIG. 7 is a side view of the components of one embodiment of the wrap in accordance with the principles of the present disclosure.
Figure 8:
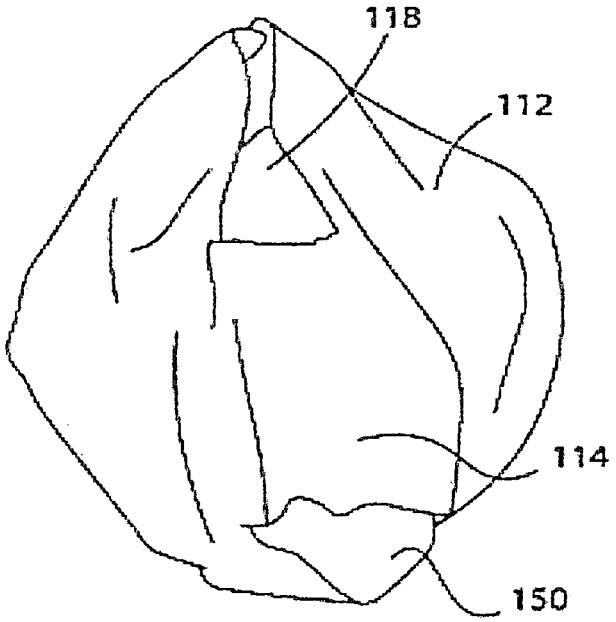
FIG. 8 is a perspective view of the components of FIG. 7.
Figure 9:
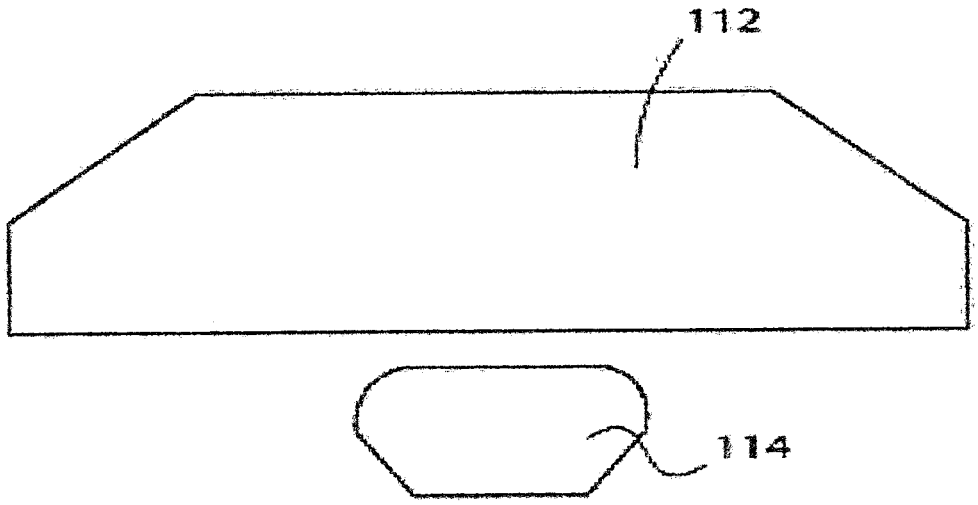
FIG. 9 is sewing pattern of the wrap in accordance with the principles of the present disclosure.

In some embodiments, wrap system 100, similar to wrap system 10 as described herein includes a fabric part 112 and a fabric part 114, as shown in the sewing pattern in FIG. 9. Part 112 includes a loop shape, as shown in FIG. 7. Part 112 includes a top portion 120 and a bottom portion 122. Top portion 120 includes a seam 124 configured to assist the user in aligning swaddle 115 properly with a head of infant I, as described herein.

Part 114 is attached, for example, by sewing to part 112 to form a swaddle 115, as described herein. Attachment of part 114 to part 112 forms a pouch 116, an opening 118 and an opening 150, as shown in FIG. 7. Pouch 116 is configured to fit a body of infant I. Opening 118 is configured for placement of a head of infant I. Opening 150 is configured for placement of the legs of infant I. Part 112 includes an elastic band 130 along a back portion 132 of wrap system 110, as described herein.

Figure 10:
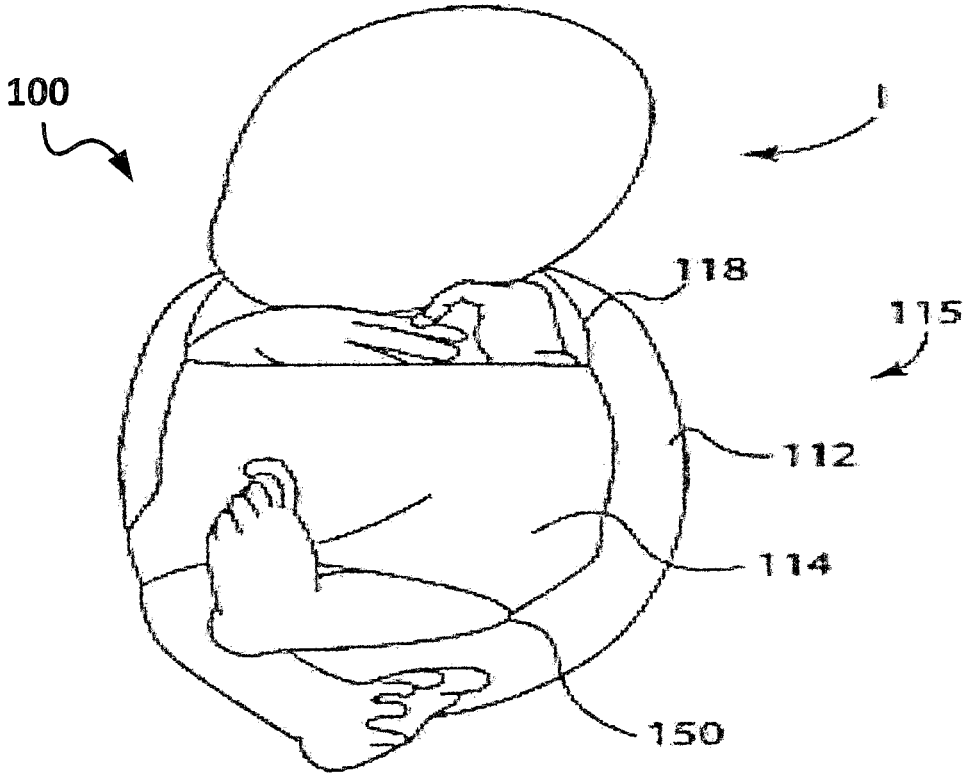
FIG. 10 is a perspective view of the components of one embodiment of the wrap in accordance with the principles of the present disclosure disposed with an infant.

In use, swaddle 115 is positioned such that elastic band 130 is towards infant I. The user positions seam 124 adjacent the head of infant I and is then placed over the head of infant I. The head of infant I is placed through opening 118. Top portion 120 is positioned behind a neck of infant I. Elastic band 130 is pulled down over the legs of infant I and over the feet of infant I, pulled up along a backside of infant I for positioning adjacent the waist band of the diaper such that a bottom half of infant I is positioned in pouch 116. The legs are pulled through opening 150, as shown in FIG. 10.

Figure 11:
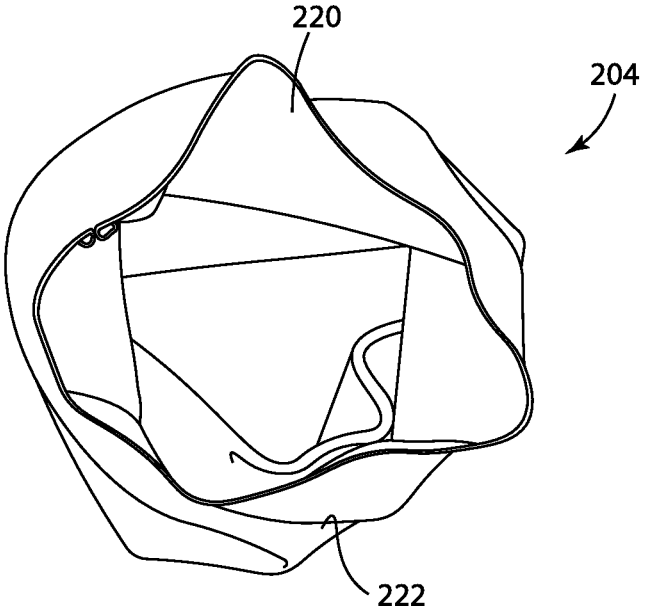
FIG. 11 is a top view of the components of one embodiment of the wrap in accordance with the principles of the present disclosure.
Figure 12:
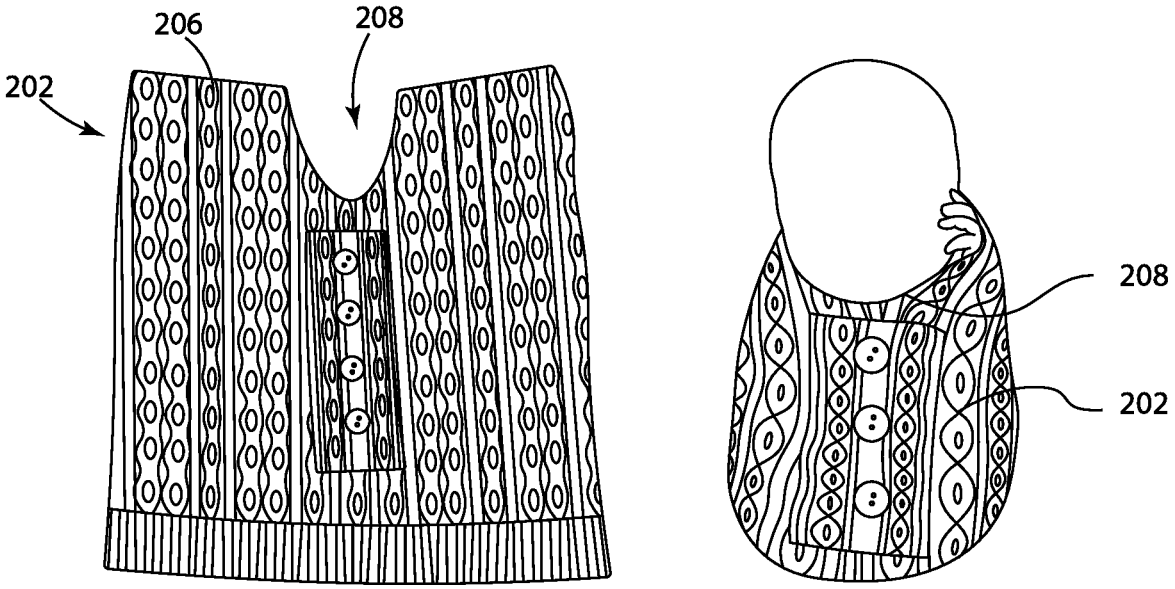
FIG. 12 is a top view of the components of one embodiment of the wrap in accordance with the principles of the present disclosure.
Figure 13:
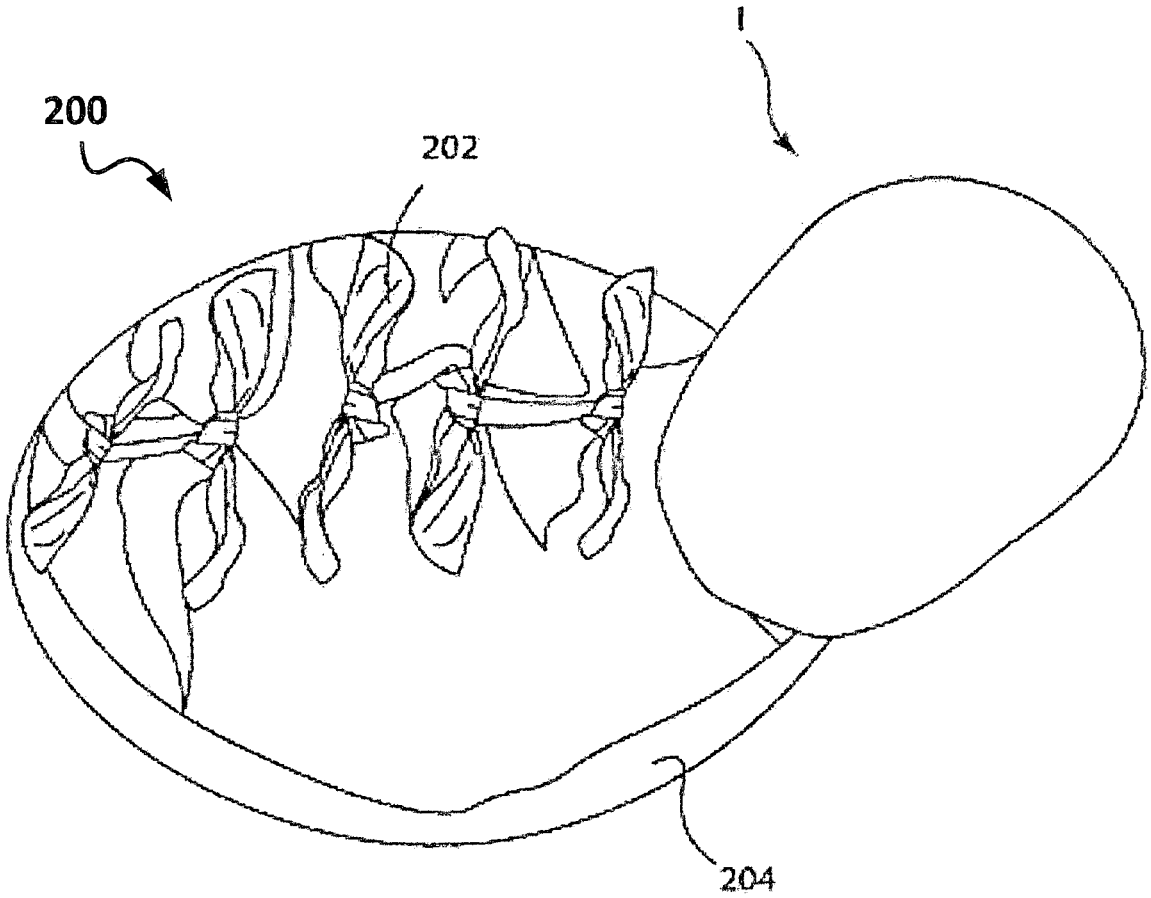
FIG. 13 is a perspective view of the components of one embodiment of the wrap in accordance with the principles of the present disclosure disposed with an infant.

In some embodiments, wrap system 200, similar to wrap system 10 includes an overlay part 202 and a second layer 204, as shown in FIGS. 11-13. Overlay part 202 includes a flat layer, as shown in FIG. 12. In some embodiments, overlay part 202 includes dimensions of approximately 15 inches by 15 inches. However, other dimensions may be utilized. In some embodiments, overlay part 202 may include decorations or be plain. In some embodiments, a top portion 206 includes a cutout, for example a notch 208. Notch 208 is configured to facilitate overlay part 202 laying flat against a neck and beneath the chin of infant I, as shown in FIG. 12.

Part 204 is similar to part 12, as described herein. Part 204 includes a top portion 220 and a bottom portion 222. In some embodiments, part 204 includes a dimension of approximately 20 inches wide by 6 inches in length. However, other dimensions may be utilized. In some embodiments, part 204 is configured to stretch horizontally about infant I.

In use, part 202 is laid across infant I with notch 208 positioned beneath the chin of infant I. Overlay part 202 is tucked underneath infant I, as shown in FIG. 12. Part 204 is positioned adjacent the head of infant I and top portion 220 is positioned behind the neck of infant I. Bottom portion 222 is pulled to the front of infant I and looped down beneath the legs of infant I, as shown in FIG. 13. Part 204 is configured to hold overlap 202 in place.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A method of wrapping an infant, the method comprising:

providing a wrap, the wrap including:

a first fabric piece configured as a loop including a front, a back, a top portion and a bottom portion defining an opening through the loop;

a second fabric piece attached on the front of the loop with the bottom portion of the loop, unattached on the front of the loop with the top portion of the loop and sealing off a portion of the opening through the loop to form a pouch; and an elastic band on the back of the loop along the bottom portion of the loop;

positioning the back of the loop with the elastic band towards the infant and with the top portion of the loop adjacent a head of the infant;

placing the top portion of the loop over the head of the infant such that the head is placed through the opening of the loop with the top portion of the loop positioned behind a neck of the infant;

pulling the back of the bottom portion of the loop down over legs of the infant; and pulling the elastic band around feet of the infant and orienting the elastic band such that a bottom half of the infant is positioned in the pouch.

2. A method of wrapping an infant, the method comprising:

providing a wrap, the wrap including:

a first fabric piece configured as a loop including a front, a back, a top portion and a bottom portion defining a first opening through the loop;

a second fabric piece attached on the front of the loop with the bottom portion of the loop, unattached on the front of the loop with the top portion of the loop and sealing off a portion of the first opening through the loop to form a pouch having a second opening into the pouch; and an elastic band on the back of the loop along the bottom portion of the loop;

positioning the wrap with the elastic band towards the infant and with the top portion of the loop at the back of the loop positioned adjacent a head of the infant;

placing the top portion of the loop over the head of the infant such that the head is placed through the opening with the top portion of the loop positioned behind a neck of the infant;

pulling the bottom portion of the loop at the back of the loop down over legs of the infant;

pulling the elastic band around feet of the infant and orienting the elastic band such that a bottom half of the infant is positioned in the pouch; and pulling the legs of the infant through the second opening of the pouch.

* * * * *